United States Patent [19]

Dietz

[11] 4,154,573

[45] May 15, 1979

[54] ADJUSTABLE IGNITION ELECTRODE ASSEMBLY

[75] Inventor: Elliot Dietz, Fishkill, N.Y.

[73] Assignee: Flynn Burner Corporation, New Rochelle, N.Y.

[21] Appl. No.: 844,393

[22] Filed: Oct. 21, 1977

[51] Int. Cl.[2] ..... F23Q 3/00

[52] U.S. Cl. ..... 431/266

[58] Field of Search ..... 431/264, 266, 257, 256

[56] References Cited

U.S. PATENT DOCUMENTS

| | | | |
|---|---|---|---|
| 139,811 | 6/1873 | Pitt | 431/257 |
| 3,172,460 | 3/1965 | Temple et al. | 431/266 X |
| 3,352,346 | 11/1967 | Temple | 431/266 X |
| 3,490,856 | 1/1970 | Temple | 431/264 |

*Primary Examiner*—Edward G. Favors
*Attorney, Agent, or Firm*—Michael Ebert

[57] ABSTRACT

An ignition electrode assembly for a gas-fired oven burner formed by a cylindrical casing having a longitudinal slot occupied by metal ribbons to define a port through which gas is emitted. Included in the assembly is an electrode unit which projects into the oven interior through a bushing in a cover plate mounted on a wall of the oven, the unit having a tip on the free end thereof. The unit is pivoted on the bushing by means of a holding collar received in the bushing and having an external handle whose movement is limited to allow the electrode unit to be swung from a normal first position to a temporary second position. In the first position, which is settable, the spacing then established between the electrode tip and the port ribbons creates a spark gap therebetween capable of sustaining a spark discharge when a high voltage is applied across the gap. In the second position, the tip makes direct contact with the port ribbons to initiate the spark discharge. The handle is spring-biased to return the tip to its normal position when the handle is released.

7 Claims, 6 Drawing Figures

11
12
20
10
22
19
18
24
34
14
19
13
15

Y
T
G
18
19
DP
17

31
29

29
15
34
27'
26
27

T
18
14
22
21
20
25
12
30
15
32
33
29
26
27
28
23
24

ADJUSTABLE IGNITION ELECTRODE ASSEMBLY

BACKGROUND OF THE INVENTION

This invention relates generally to ignition electrode assemblies for gas-fired oven burners, and more particularly to an electrode assembly whose electrode unit projects through a bushing in the cover plate in the wall of the oven and is pivoted therefrom whereby the tip at the free end of the unit is swingable from a pre-set first position in which the tip is spaced from the gas-emitting port of the burner to define a spark gap therebetween to sustain a spark discharge to a second position in which the tip is in direct contact with the port to initiate the spark discharge.

U.S. Pat. Nos. 2,715,200 and 3,505,568 J. H. Flynn disclose an ignition electrode unit operable in conjunction with a gas-fired burner which takes the form of an elongated cylindrical casing having a longitudinal slot within which are disposed corrugated metal ribbons forming a port from which the gas is emitted This gas is ignited by an electrical spark discharge which jumps across the spark gap between the tip of the electrode unit and the port ribbons.

The high-voltage for producing the ignition spark is derived from a step-up transformer, the voltage being applied between the electrode and the ribbons. In order to obtain optimum performance, the tip must lie in the diametrical casing plane passing through the burner port and a proper spacing must be maintained between the tip and the port ribbons. But even if the gap is properly set when the electrode unit is initially installed, the tip becomes eroded or dirty or warps with prolonged use, and erratic ignition is encountered, making it necessary to shut down the oven to clean, bend or replace the tip.

When ignition electrode units are used in conjunction with gas-fired burners in baking ovens, still other difficulties are encountered. As pointed out in the Temple U.S. Pat. No. 3,490,856, chains travelling within such baking ovens are usually lubricated with a graphite composition. The graphite tends to collect or deposit on the burner ribbons, and this gives rise to ignition problems.

When ignition is erratic or does not take place as soon as the gas burner is turned on, this results in the emission of unignited gas within the oven and create a dangerous condition; for if ignition occurs only after the oven is filled with unignited gas, it may produce an explosion.

In order to overcome this problem, Temple provides an electrode assembly in which the electrode rod supporting the tip is rotatable, making it possible from an external point to manipulate the tip so that it wipes the port ribbons and thereby dislodges the graphite therefrom. In this arrangement, the electrode tip moves in an arc which intercepts the diametrical casing plane passing through the port; hence when the electrode is displaced from this plane to establish a spark gap, this gap will not lie in the diametrical plane but will be displaced therefrom, as a consequence of which optimum gap conditions do not obtain.

In the arrangements disclosed by the Flynn and Temple patents, the oven wall cover plate on which the ignition assembly is supported is provided with a sight hole through which one can observe the spark gap to see whether proper ignition has taken place. But in these patents, the arrangement is such that the electrode assembly projecting into the oven is supported by means of a bracket attached to the burner casing. This brakcet is interposed in the optical path between the sight hole and the spark gap and therefore interferes somewhat with the view of the gap.

SUMMARY OF INVENTION

In view of the foregoing, it is the main object of this invention to provide an ignition electrode assembly for a gas-fired oven burner, the assembly including a pivoted electrode unit having a tip which is swingable from a normal first position in which the tip is spaced from the gas-emitting port of the burner to define a spark gap to sustain a spark discharge to a second temporary position in which the tip is in direct contact with the port to initiate the spark discharge.

More particularly, it is an object of this invention to provide an electrode assembly whose electrode unit is held within a collar that is pivoted from a bushing in the cover plate through which the unit projects into the oven, the collar having an external handle which cooperates with a stud projecting from a cover plate, whereby the handle may be manipulated from the first position determined by a stop nut on the stud to the second position in direct contact with the port.

Another object of this invention is to provide an electrode assembly which makes it possible to change the spark gap externally by means of the stop nut in order to avoid disassembly of the electrode in case of erosion, dirt, or warpage at the electrode tip.

Also an object of the invention is to provide a cover plate having a sight hole therein affording an unimpaired view of the spark gap at the tip of the electrode unit.

Briefly stated, these objects are attained in an ignition electrode assembly for a gas-fired oven burner formed by an elongated cylindrical casing having a longitudinal slot therein occupied by corrugated metal ribbons to define a port through which gas is emitted.

The ignition assembly includes an electrode unit which projects into the oven through a bushing in a cover plate mounted on a wall of the oven, the unit being pivoted on the bushing by means of a holding collar received within the bushing, the collar having an external handle extending laterally therefrom.

Anchored on the cover plate and projecting therefrom is a stud which extends through a slot in the handle, a spring being mounted on the stud to urge the handle against a stop nut whose position on the stud is adjustable to set the spark gap established between an electrode tip at the free end of the unit and the port ribbons whereby a spark discharge may be sustained when a high voltage is applied across the gap. By pushing in the handle against the spring, the tip is caused to swing from its pre-set position to a temporary position in direct contact with the port ribbons to initiate the spark discharge, the handle when released reverting to its normal position against the stop nut.

OUTLINE OF DRAWINGS

For a better understanding of the invention as well as other objects and further features thereof, reference is made to the following detailed description to be read in conjunction with the accompanying drawings, wherein.

DESCRIPTION OF INVENTION

Figure 1:
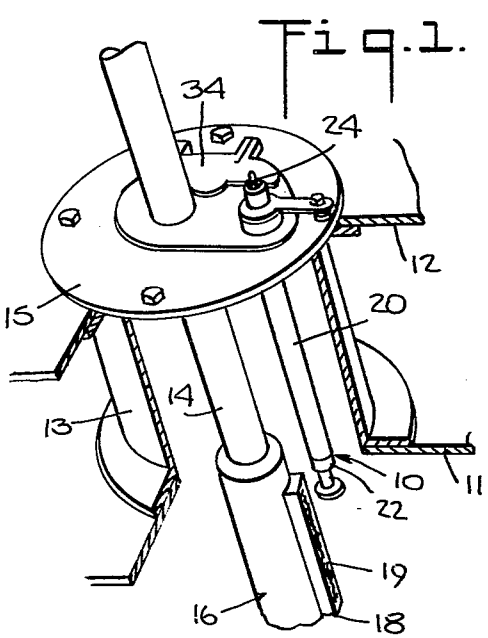
FIG. 1 is a perspective view of an adjustable ignition electrode assembly in accordance with the invention which is installed in an oven whose front wall is cut away.
Figure 3:
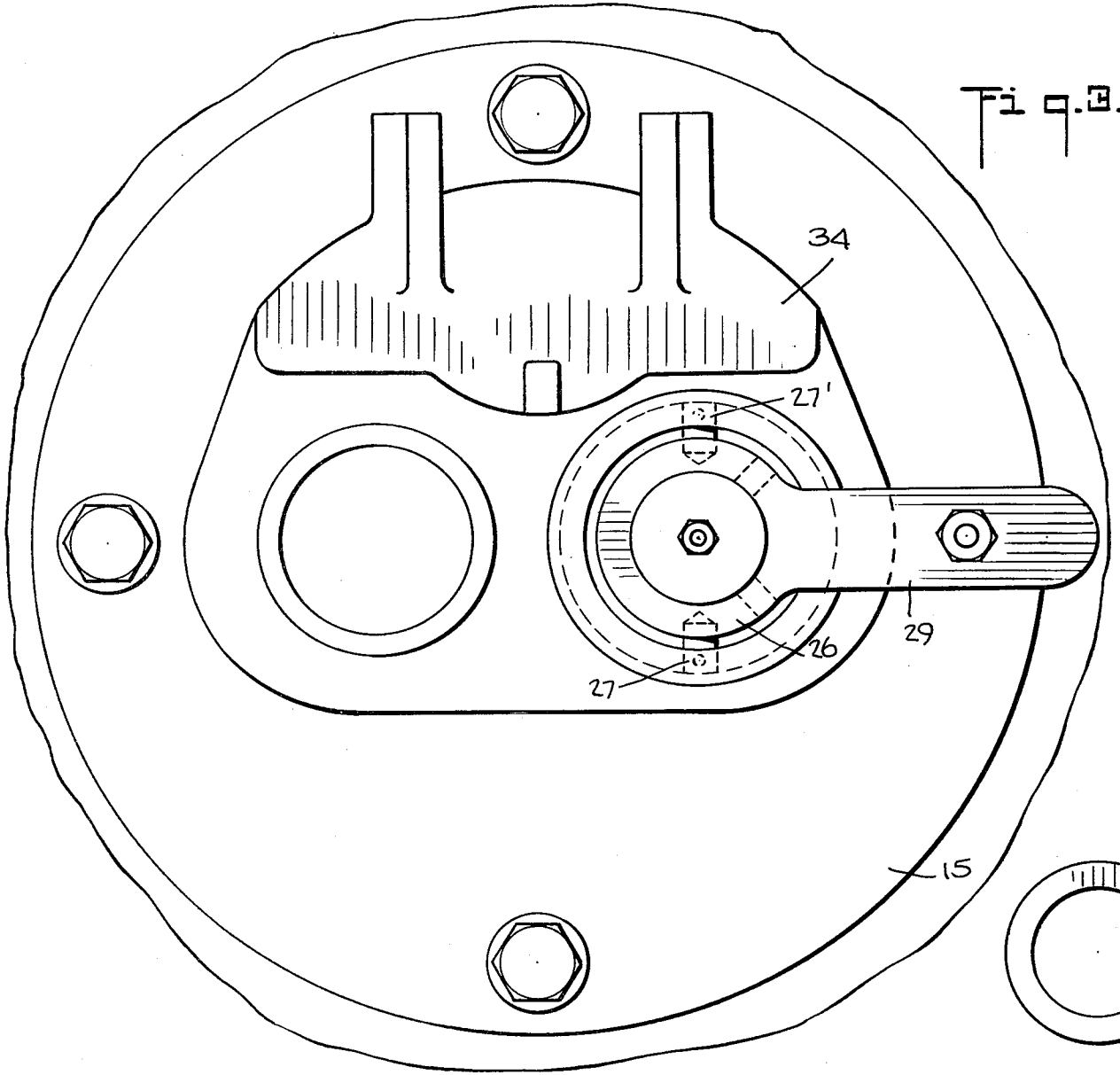
FIG. 3 is an end view of the cover plate mounted on the front wall of the oven to support the ignition electrode assembly and the burner.
Figures 2, 6:
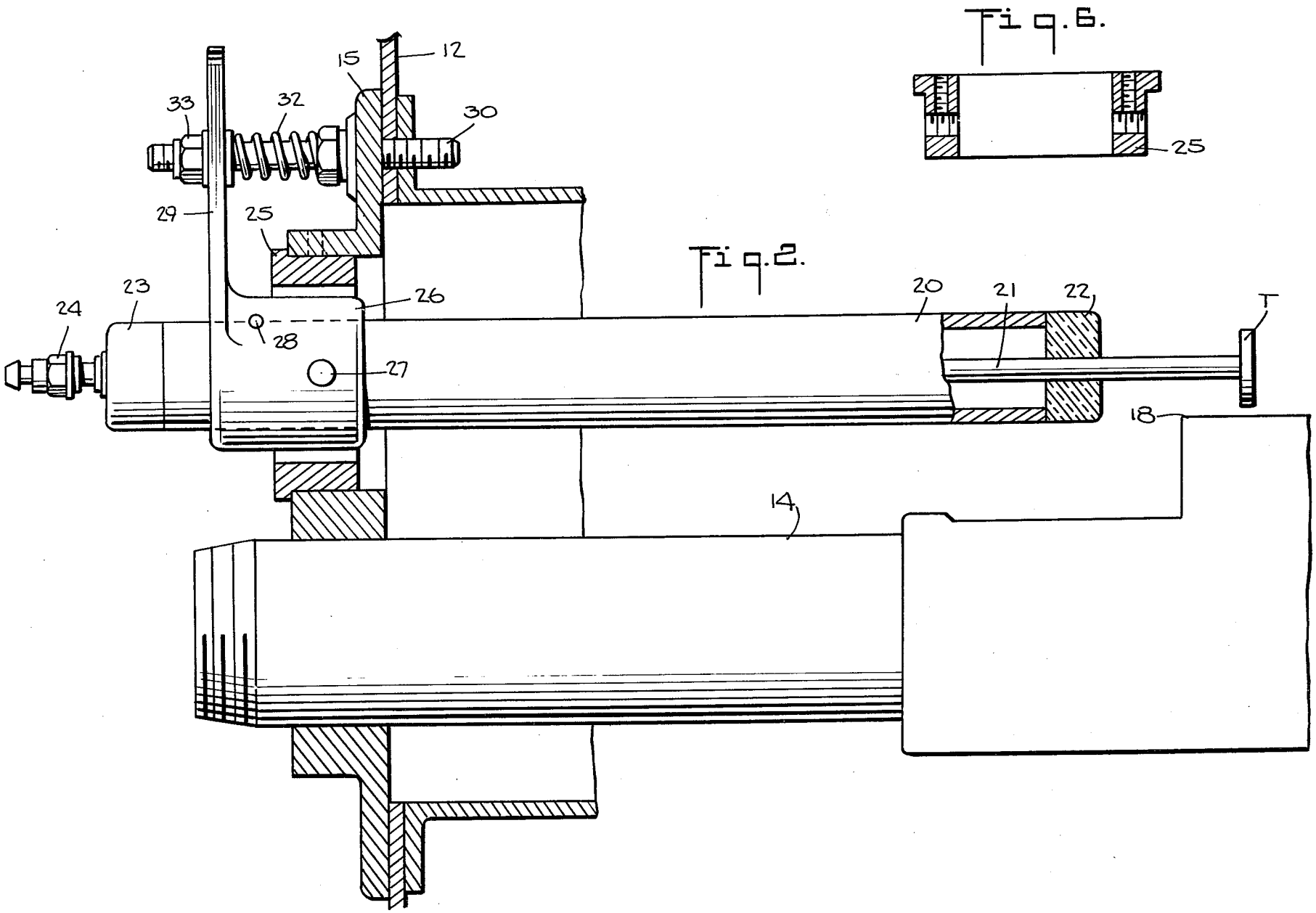
FIG. 2 is an elevational view of the electrode assembly and the gas-fired burner associated therewith.
FIG. 6 is a sectional view of the bushing within which the collar is received.

Referring now to the drawings, and more particularly to FIGS. 1, 2 and 3, there is shown an ignition electrode assembly in accordance with the invention, generally designated by numeral 10, which is installed in a bakery oven or the like. The front wall of the oven is constituted by inner and outer panels 11 and 12, the space between panels being filled with suitable thermal insulation (not shown).

Interposed between the inner and outer panels 11 and 12 of the front wall is a sleeve 13 through which the ignition assembly 10 and a gas/air mixture supply pipe 14 is projected into the interior of the oven. The outer ends of the gas pipe and the assembly are supported on a cover plate 15 secured by bolts to the outer panel 12 of the front wall.

Gas supply pipe 14 is coupled to a gas-fired burner 16 constituted by an elongated cylindrical casing 17 having a longitudinally-extending slot 18 within which is disposed an array of corrugated metal ribbons 19 to form a port from which is emitted the gas fed into the casing by feed pipe 14. It will be seen in FIG. 4 that the diametrical plane DP of the burner casing passes vertically through the center of the port as well as the center of an electrode tip T spaced above the port to define a spark gap G.

Ignition electrode assembly 10 includes an ignition electrode unit formed by an outer tube 20, which may be of steel, within which is coaxially supported a conductive rod 21 by means of end pieces 22 and 23. These end pieces are fabricated of non-conductive, heat-resistant material, preferably a ceramic composition. Rod 21 extends beyond the free end of the ignition electrode unit to provide a cantilever support for electrode tip T which may be of disc, hatchet or any other suitable shape, a disc being shown. The outer end of rod 21 is connected to a terminal 24 to which the "hot" lead of a high voltage supply is connected, the grounded side of the supply being common with the oven.

Since the metal casing of the burner is connected to ground, a high voltage is established across gap G to produce a spark discharge when the gap spacing is such relative to the applied voltage as to give rise to a breakdown of the air dielectric in the gap.

Fitted within an opening in cover plate 15 is a metal bushing 25 which is preferably machined of aluminum. The outer tube 20 of the ignition electrode unit is secured by a set screw 28 to a holding collar 26 which is received within bushing 25, the outer diameter of the collar being somewhat smaller than the inner diameter of the bushing. Collar 26 is pivoted within bushing 25 by means of a pair of diametrically-opposed pivot pins or gudgeons 27 and 27' which lie along a vertical axis Y; hence the ignition electrode unit is swingable in a horizontal plane in the manner of a trunnioned cannon.

Figure 4:
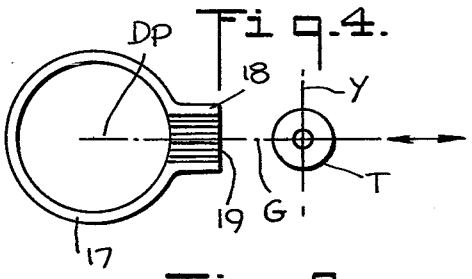
FIG. 4 is a transverse section taken through the casing of the burner to show the relationship between the burner and the ignition electrode tip.
Figure 5:
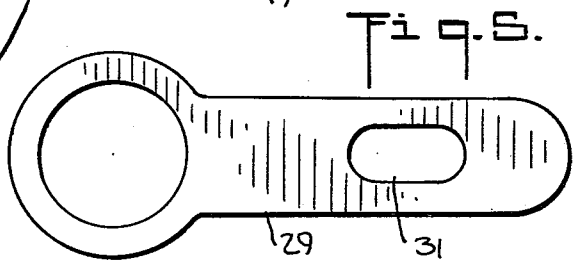
FIG. 5 is a front view of the holding collar for the electrode unit.

The geometry of the arrangement is such, as shown in FIG. 4, that the center of tip T moves left and right in a horizontal plane that coincides with the diametrical plane DP passing through the center of burner casing 17. Thus when the ignition electrode unit is swung toward the left, it causes tip T to move toward the port ribbons 19 within the diametrical plane DP, and when swung toward the right, it moves away from the ribbons in the same plane.

Collar 26 is provided with an external handle 29 which extends laterally from the collar in the horizontal direction. Hence by manipulating handle 29, one may swing the ignition electrode unit about its vertical pivot axis X. This degree of swing is limited by a spring-mounting stud 30 which is anchored on cover plate 15 and projects outwardly therefrom, the stud passing through an elongated slot 31 in the handle.

Mounted on stud 30 is a helical spring 32 which is interposed between the handle and the cover plate. Spring 32 urges handle 29 against a stop nut 33 threadably received on stud 30, the position of the nut determining the normal position of the handle which in turn determines the first position of tip T relative to the port ribbon 19. The first position is set by adjustment of stop nut 33.

When the handle is pushed in against the tension of spring 32, tip T advances toward burner 16 until it makes direct contact with port ribbons 19, this being the second or temporary position of the handle. When the handle is released, spring 32 returns tip T to its first or normal position.

Thus the first position is set to provide a spark gap whose spacing is such as to sustain optimum spark discharge conditions for ignition of the gas emitted by the burner. The second position results in the momentary short, and when the electrode tip is withdrawn, it draws a spark to initiate spark discharge.

Cover plate 15 is also provided with a hinged door 34 which when opened exposes a sight hole through which one may observe the spark gap to see whether ignition has taken place. Since there is no obstacle or bracket in the optical path between the sight hole and the tip T, no difficulty is experienced in seeing the spark gap.

While there has been shown and described a preferred embodiment of an adjustable ignition electrode assembly in accordance with the invention, it will be appreciated that many changes and modifications may be made therein without, however, departing from the essential spirit thereof.

I claim:

1. An ignition assembly for a gas-fired oven burner formed by a cylindrical casing having a longitudinal slot occupied by metal ribbons to define a port through which gas is emitted, the diametrical plane of the casing passing through said port, said assembly comprising:

(A) an ignition electrode unit having an electrode tip at one end thereof and means to apply a high voltage between the tip and the metal ribbons to sustain a spark discharge in the air gap therebetween; and (B) handle-operated spring-biased means to pivotally support said unit on a wall of the oven whereby in its normal first position the center of said tip intercepts said diametrical plane, said tip being swingable by said handle from said first normal position in which said tip is spaced from the port ribbons to an extent defining an optimum air gap for sustaining a spark discharge to ignite the gas emitted through said port to a second temporary position in which said tip makes direct contact with said ribbons to short-circuit said high voltage to initiate said discharge, said handle when released causing said tip to revert to its normal position to sustain the discharge to ensure full ignition of said gas.

2. An assembly as set forth in claim 1, wherein said unit is formed by a conductive rod coaxially supported by insulating pieces within a metal tube, said rod extending beyond said tube to support said tip.

3. An assembly as set forth in claim 1, wherein said burner and said assembly are supported by a cover plate mounted on the wall of the oven, said plate having a bushing therein through which said electrode unit is projected into the interior of the oven, said unit being secured to a holding collar received within said bushing and pivoted therefrom by pivot pins lying in the vertical plane.

4. An assembly as set forth in claim 3, wherein said collar is provided with an external handle extending laterally therefrom, said handle being movable within limits that determine said first and second positions.

5. An assembly as set forth in claim 4, wherein said limits are determined by a stud projecting from said cover plate and passing through a slot in said handle, and a stop nut on said stud to restrict the movement of said handle.

6. An assembly as set forth in claim 5, further including a helical spring mounted on said stud to urge said handle against said nut.

7. An assembly as set forth in claim 6, wherein said cover plate includes a sight hole covered by a door.

* * * * *